US008202559B2

(12) United States Patent
Leimkuhler

(10) Patent No.: US 8,202,559 B2
(45) Date of Patent: Jun. 19, 2012

(54) MICROWAVE VEGETABLE PREPARATION

(75) Inventor: James K. Leimkuhler, Los Angeles, CA (US)

(73) Assignee: Progressive Produce Corporation, Los Angeles, CA (US)

( * ) Notice: Subject to any disclaimer, the term of this patent is extended or adjusted under 35 U.S.C. 154(b) by 1390 days.

(21) Appl. No.: 10/920,721

(22) Filed: Aug. 18, 2004

(65) Prior Publication Data

US 2006/0040021 A1 Feb. 23, 2006

(51) Int. Cl.
*A23B 7/16* (2006.01)

(52) U.S. Cl. ..... 426/106; 426/113; 426/118; 426/122; 426/123

(58) Field of Classification Search ..... 426/234, 426/106, 113, 118, 122, 123; 229/87.05, 229/87.08; 206/497
See application file for complete search history.

(56) References Cited

U.S. PATENT DOCUMENTS

| | | | | | |
|---|---|---|---|---|---|
| 1,969,730 | A | | 8/1934 | Daughters | |
| 2,333,887 | A | * | 11/1943 | Redlinger | 426/310 |
| 2,360,597 | A | * | 10/1944 | Topolski | 229/87.05 |
| 2,452,174 | A | * | 10/1948 | Arnold | 426/106 |
| 2,467,875 | A | * | 4/1949 | Andrews | 426/123 |
| 2,580,599 | A | | 1/1952 | Rogers | |
| 2,622,986 | A | * | 12/1952 | Snyder et al. | 426/122 |
| 2,865,765 | A | * | 12/1958 | Allen | 426/393 |
| 3,201,258 | A | * | 8/1965 | Mastella | 426/5 |
| 3,641,732 | A | * | 2/1972 | Fujio | 53/412 |
| 4,596,713 | A | * | 6/1986 | Burdette | 426/107 |
| 4,867,995 | A | * | 9/1989 | Oaks | 426/234 |
| 5,171,593 | A | * | 12/1992 | Doyle | 426/106 |
| 5,221,548 | A | * | 6/1993 | Walton, Jr. | 426/523 |
| 5,226,735 | A | * | 7/1993 | Beliveau | 383/103 |
| 5,318,818 | A | * | 6/1994 | Sjostrom | 428/43 |
| 5,413,412 | A | | 5/1995 | Odabashiam | |
| 5,492,705 | A | | 2/1996 | Porchia et al. | |
| 5,665,411 | A | | 9/1997 | Bassetti | |
| 5,738,893 | A | * | 4/1998 | Kornet et al. | 426/413 |
| 5,770,839 | A | * | 6/1998 | Ruebush et al. | 219/727 |
| 5,863,585 | A | * | 1/1999 | Sjoberg | 426/389 |
| 5,914,142 | A | | 6/1999 | Zartner et al. | |

(Continued)

FOREIGN PATENT DOCUMENTS

DE 8715429.3 2/1988

(Continued)

OTHER PUBLICATIONS

"Throughout—Definition from Dictionary.com" Jan. 17, 2007. Based on the Random House Unabridged Dictionary, 2006. http://dictionary.reference.com/browse/throughout p. 1.*

*Primary Examiner* — Kelly Bekker
(74) *Attorney, Agent, or Firm* — Venable LLP; Stefan J. Kirchanski

(57) ABSTRACT

An improved method of preparing vegetables intended for microwave cooking allows a hot, cooked vegetable to be easily removed from an enveloping film. The vegetables are cleaned and seasonings and cooking aids such as oils are optionally applied to the vegetable. Then the prepared vegetables are enclosed by and sealed into a plastic film. The film protects the vegetable from excess desiccation and provides a "built-in" container for microwave cooking. The film includes an opening system for safely releasing the vegetable after cooking. A tear-strip includes an edge or tab for grasping so that the film can be opened by a simple pull.

53 Claims, 3 Drawing Sheets

U.S. PATENT DOCUMENTS

| | | | | |
|---|---|---|---|---|
| 5,914,144 | A * | 6/1999 | Wolfe et al. | 426/412 |
| 6,054,698 | A * | 4/2000 | Mast | 219/730 |
| 6,077,551 | A * | 6/2000 | Scrimager | 426/107 |
| 6,190,710 | B1 | 2/2001 | Nir et al. | |
| 6,308,990 | B1 * | 10/2001 | Brick | 283/79 |
| 6,749,877 | B2 | 6/2004 | Hodson et al. | |
| 6,818,873 | B2 * | 11/2004 | Savage et al. | 219/730 |
| 2001/0000480 | A1 | 4/2001 | Stagg et al. | |
| 2003/0201314 | A1 * | 10/2003 | Perenyi et al. | 229/87.05 |
| 2005/0163950 | A1 | 7/2005 | Martin | |

FOREIGN PATENT DOCUMENTS

| | | |
|---|---|---|
| EP | 0270838 | 6/1988 |
| WO | 03/062077 | 7/2003 |

* cited by examiner

MICROWAVE VEGETABLE PREPARATION

BACKGROUND OF THE INVENTION

1. Area of the Art

The present invention is in the area of simplified cooking of fresh produce and is more specifically involved with a device and method to facilitate the microwave cooking of fresh vegetables such as potatoes and sweet corn.

2. Description of the Prior Art

It is known in the art to wrap a vegetable in plastic film and then cook it in a typical microwave oven. In fact, many brands of "plastic wrap" specifically advertise that they are "microwavable." This method for cooking fresh vegetables is applicable to a wide variety of vegetables but is especially suitable for firm vegetable that require a reasonable amount of cooking to make them palatable; such suitable vegetables include potatoes, both regular and sweet, corn, hard or autumn squash, artichokes, brussel sprouts, asparagus and onions. U.S. Pat. No. 5,665,411 to Bassetti discloses shipping sweet potatoes in a special heat shrunk film that preserves the sweet potatoes and is suitable for microwave cooking.

A major drawback to this method of cooking vegetable is that the plastic film becomes somewhat softened at cooking temperatures so that removal of the film at the end of the cooking process is difficult without receiving a burn from trying to hold the cooked vegetable or from the steam released when the plastic veil is pierced. It is extremely difficult safely to grasp the vegetable (think "hot potato") and remove the plastic since protective gloves render removal of the plastic virtually impossible. Attempts to safely detach the plastic may result in hot vegetable on the floor or in the lap. Bassetti specifically recommends allowing the potato to cool before removing the plastic film. However, most consumers prefer hot vegetables and it seems counterproductive to have to cool the vegetable to remove the plastic and then reheat the vegetable for serving.

Therefore, there is a considerable need for a system to enable microwave cooking of vegetables where the enveloping plastic film can be easily removed without risking burns or dropped steaming produce.

SUMMARY OF THE INVENTION

The invention provides an improved method of preparing vegetables intended for microwave cooking. The vegetables are cleaned and seasonings and cooking aids such as oils are optionally applied to the vegetable. Then the prepared vegetables are enclosed by and sealed into a plastic film. The film protects the vegetable from excess desiccation and provides a "built-in" container for microwave cooking. The film includes an opening system for safely releasing the vegetable after cooking.

One opening system consists of a tear-strip, which is adhesively attached to the film of the sealed vegetable. The tear-strip includes a portion that is not adhered to the film. This portion can be either at an end of the tear-strip or located along one edge of the length of the strip. The not adhered portion can be conveniently grasped and pulled to release the hot, cooked vegetable without burning ones fingers. The tear-strip may be enhanced by placing the strip in conjunction with a perforation or zone of weakness. An alternative opening system can be based on an attached or embedded fiber or strip, which can be manipulated to rip the film open.

An additional modification includes modifying the gas permeability of the film by embossing a plurality of tiny holes into the film. These holes allow gas exchange and prevent excess moisture accumulation during cooking. Careful adjustment of the gas permeability can significantly extend the shelf life of the prepared vegetables. The number and size of these perforations can be adjusted to accommodate the needs of different types of vegetables.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved method and device for microwave cooking of vegetables.

It became apparent to the present inventor that removal of the plastic film was a major impediment to using plastic film to cook vegetables in a microwave oven. The use of tear-strips and other "easy open" structures with plastic film packaging is well established in the field of packaging but such devices have not been applied to removing plastic film from hot cooked items.

Perhaps the simplest "easy open" device is a line of perforations or similar weakness in a plastic film so that pulling on the plastic on either side of the perforation results in film opening along the perforations. The problem with this approach is that where the film is tightly molded around a hot potato or similar item, it is essentially impossible to grasp the film to apply force to the perforations without burning one's fingers. It is possible to hold the hot vegetable with an oven mitt, but if both hands are so protected, grasping the film to cause the perforation to tear is virtually impossible. Therefore, a viable opening system should include not only a perforation or similar "zone of weakness" but also a way to apply opening force to the perforation without burning one's fingers. Since the most likely way to handle a hot potato (or similar vegetable) is to hold it with an insulated mitt or similar device, the opening system ideally can be operated with one hand and will incorporate a handle, tab or similar emergence that protects bare fingers from the hot food item. It is possible for the tab to be adhesively attached to the film so as to generate a tear in the film without a preexisting perforation or zone of weakness.

Figure 1:
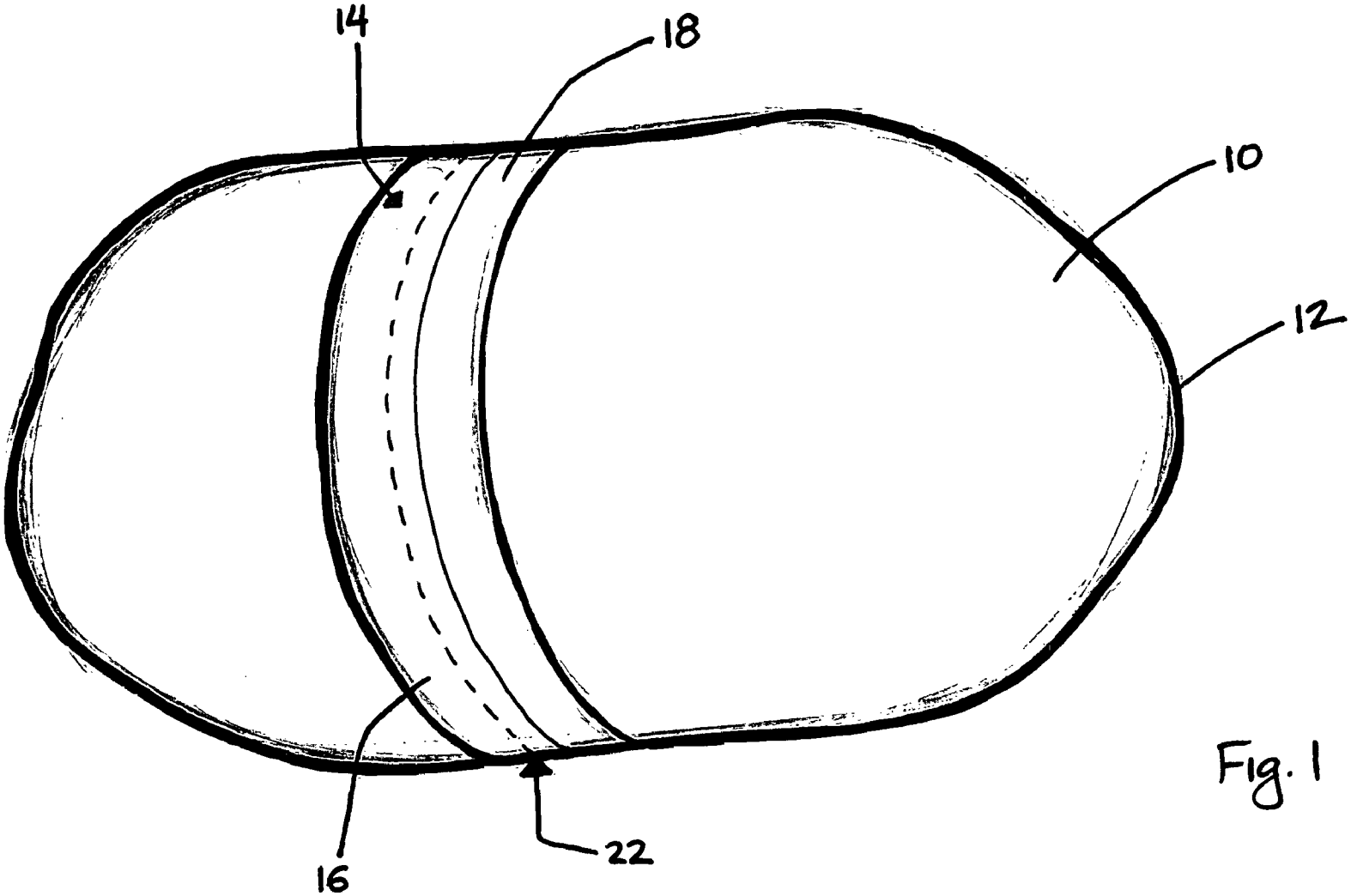
FIG. 1 is a diagram of a vegetable with the present invention
Figure 2:
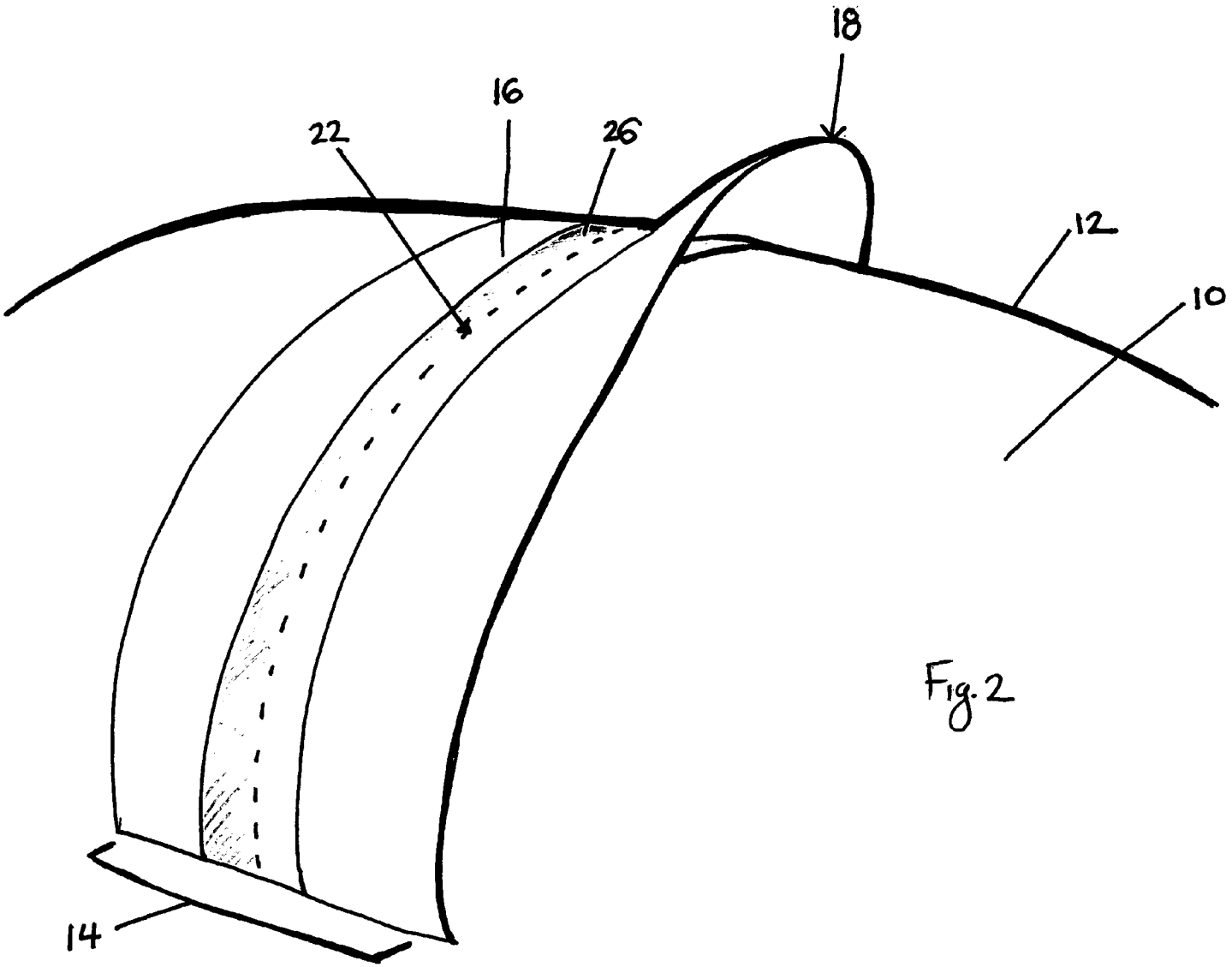
FIG. 2 is close-up diagrammatic view of a portion of FIG. 1.

With these points in mind one viable design for opening a hot vegetable includes an adhesively attached tape segment including a non-adhesive edge applied over a perforation in the plastic film. As shown in FIG. 1 a vegetable to be cooked (here a potato) 10 is sealed in a tight-fitting plastic film 12 to which is applied a tear-strip 14 which consists of a length of tape with an adhesive portion 16 (cross-hatched) with a non-adhesive edge portion 18 or end tab (not shown) which can be easily grasped. Ideally the tear-strip 14 is applied over a row of perforations or similar zone of weakness 22. FIG. 2 shows a close-up of a portion of a vegetable equipped with the present invention to show the relationship between the tear-strip 14 and the perforations or zone of weakness 22. The adhesive 26 of portion 16 is shown. Tear-strips of this description are available from a number of vendors such as the PEELWRAP® from the Sealstrip Corporation of Boyertown, Pa. Ideally, the adhesive on the strip is one that is actually hardened by the cooking heat so that the strip will not loosen during the cooking process.

Figure 3:
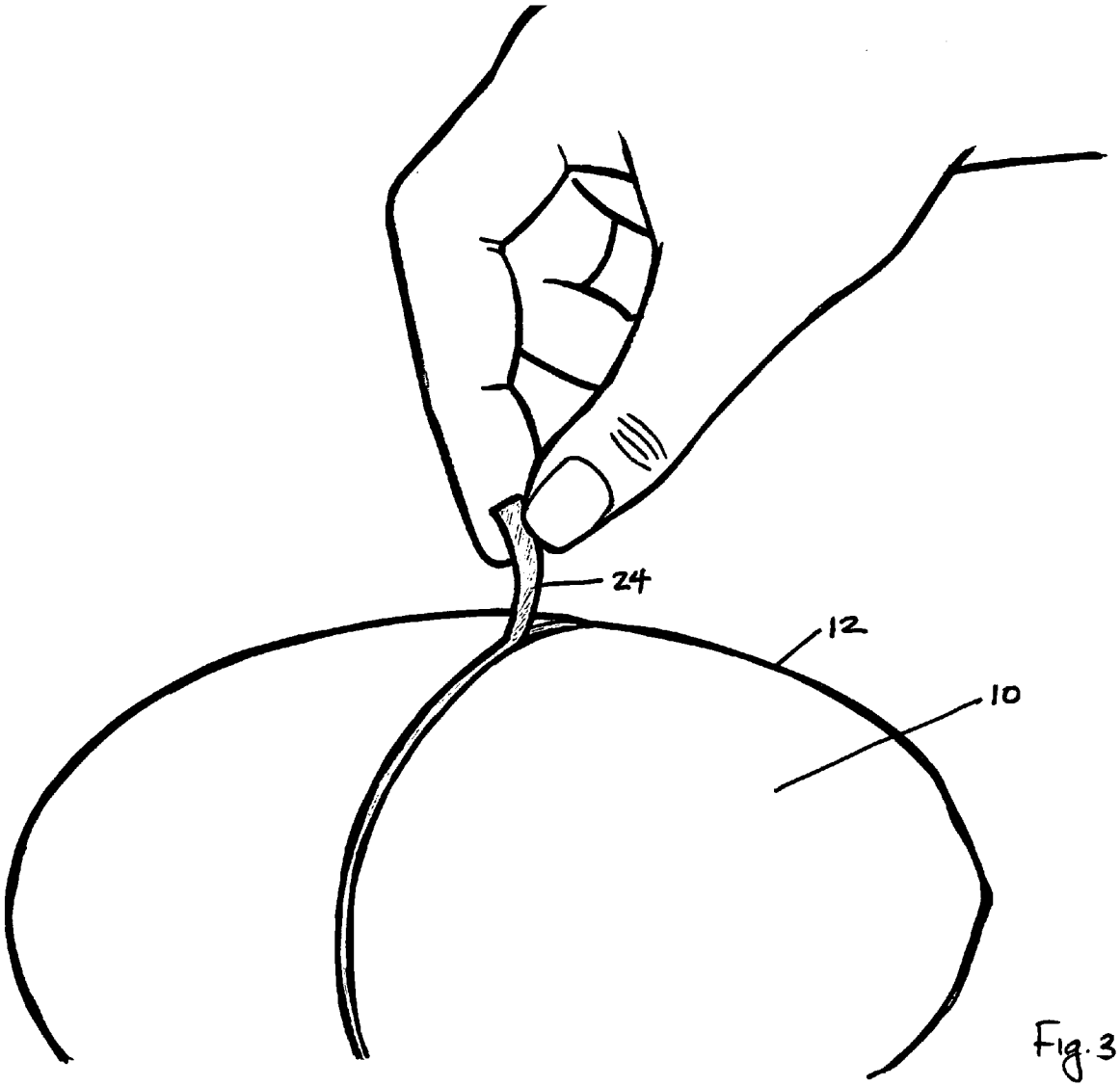
FIG. 3 is close-up diagrammatic view of a pull string based opener.

Alternately, the tear strip 14 can be in the form of a string or fiber that is embedded in the film 12 or actually in contact with or adhered to an inner surface of the film 12. When such a string is pulled, it cuts through the film 12 with no requirement for a zone of weakness in the film 12 although such a zone 22 can be provided. FIG. 3 shows a close-up of such an alternative with the cutting string 24 being pulled by a user to open the film 12. The cutting string 24 can be in the form of a fiber or strip that is attached to, in contact with an inner surface of or embedded in the film 12.

The plastic film 12 is optimally applied to the vegetable by specialized machinery and is designed to tightly envelop the vegetable. The film can be a film that shrinks in response to heat or other stimulus (drying, etc.) so as to form fit the vegetable. A suitable film is a polyolefin film such as Cryovac LD-935 produced by the Sealed Air Corporation of Duncan, S.C. It will be apparent to one of skill in the art that permeability of the film to air and water vapor is an important consideration. Living vegetables respire by taking in oxygen and expelling carbon dioxide. Many plastic films are sufficiently permeable to oxygen and carbon dioxide so as to not interfere with normal respiration. Vegetables contain a large amount of water so there is a significant advantage to preventing excess water loss during storage and transport particularly for "green" vegetables such as sweet corn, asparagus and artichokes. However, water permeability poses a different problem during the cooking process. Certainly, it is important for the film 12 to prevent excessive water loss during cooking; however, if the film 12 retains too much water vapor, the film may balloon and even "explode" during the cooking process. Also, different vegetables benefit from different degrees of water vapor retention during cooking. For example, items like artichokes may become toughened and even crisp if excess water is lost—definitely not desirable with artichokes. On the other hand, the consistency of baked potato skins can be enhanced by some water loss. The inventor has found that it is not adequate to trust to the inherent gas permeability properties of the film as manufactured. Instead it is more efficacious to specifically modify permeability during the packaging process. To this end the packaging system causes the film to run over or between two embossing rollers where a plurality of small tines or similar protuberances prick tiny holes in the film. For example a system for packaging potatoes might introduce about 72 punctures per square foot with each puncture having a diameter of about 0.020 inches. Normally these tiny holes provide gas exchange for respiration with relatively little water vapor loss. Under cooking conditions, the film 12 may soften somewhat and stretches so that the holes enlarge somewhat to release excess pressure. It will be apparent that the density and size of the holes can be adjusted to accommodate the needs of different vegetables.

The vegetable is cleaned and otherwise prepared for cooking. For example, in the case of sweet corn or artichokes the preparation can include removal of extraneous material (e.g., husks) and addition of seasonings and other cooking aids (e.g., oils). The prepared vegetable is enclosed and sealed in the plastic film 12 and the tear-strip 14 is applied either during or after the enclosing process. The film 12 is stretched over the vegetable and cut/sealed by an electrostatic, heat or similar cutting/sealing device. Then the film 12 is caused to shrink (usually through the application of heat) to snugly envelop the vegetable. The vegetable is shipped to the market under controlled conditions (if necessary); for example, corn, artichokes, asparagus, potatoes and onions benefit from refrigeration.

The consumer purchases the items and prepares them by simply places them in a microwave oven and cooks them for the requisite amount of time. The recommended cooking time can be placed on a label or printed directly on the film 12. Alternatively, the "moisture sensor" present in many microwave ovens can be used to automatically control the cooking time. After the items are cooked, each one can be grasped with one hand (using a protective mitt, if needed) and the tear strip 14 pulled with the other to split open the film 12 so that the vegetable can be released. Because the tear strip 14 ideally has an edge and/or end not adhered to the hot food item, it is possible to pull the strip 14 with an unprotected hand although protective tools can also be employed.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. A method of packaging and cooking a vegetable where the package protects the vegetable and serves as a cooking container comprising the steps of:

selecting a vegetable from a group of different types of vegetables;

preparing the selected vegetable;

providing shrinkable plastic film;

modifying gas permeability of the film according to the type of the selected vegetable to be packaged, wherein the step of modifying includes making a plurality of about 0.02 inch diameter holes in said film;

attaching an opening system to said film;

sealing the modified film around the selected vegetable;

shrinking the film to tightly envelop the selected vegetable;

marketing the enveloped vegetable;

cooking the enveloped vegetable in a microwave oven; and operating the opening system to release the vegetable from the film.

2. The method of claim 1, wherein the selected vegetable is selected from the group consisting of potatoes, onions, corn, artichokes, brussel sprouts, asparagus and squash.

3. The method of claim 1, further comprising a step of adding at least one of salt, flavors, seasonings, herbs and oils.

4. The method of claim 1, wherein the opening system includes a zone of weakness.

5. The method of claim 1, wherein the opening system includes a tear strip.

6. The method of claim 5, wherein the tear strip consists of an adhesive portion for adhering to said film and a non-adhesive portion to be pulled to release the vegetable from the film.

7. The method of claim 1, wherein the opening system consists of a strip or fiber attached to, embedded in or in contact with an inner surface of the film, wherein an end of the strip or fiber is pulled to release the vegetable from the film.

8. The method of claim 1, wherein the step of shrinking includes heating the film.

9. A method of packaging and cooking a vegetable where the package protects the vegetable and serves as a cooking container comprising the steps of:

selecting a vegetable from a group of different types of vegetables;

providing shrinkable plastic film;

modifying gas permeability of the film according to the selected vegetable to be packaged, wherein the step of modifying includes making a plurality of about 0.02 inch diameter holes throughout the surface area of said film;

attaching an opening system to said film;

sealing the modified film around the selected vegetable;

shrinking the film to tightly envelop the selected vegetable;

marketing the enveloped vegetable;

cooking the enveloped vegetable in a microwave oven; and operating the opening system to release the vegetable from the film.

10. The method of claim 9, wherein the selected vegetable is selected from the group consisting of potatoes, onions, corn, artichokes, brussel sprouts, asparagus and squash.

11. The method of claim 9, further comprising a step of adding at least one of salt, flavors, seasonings, herbs and oils.

12. The method of claim 9, wherein the step of modifying comes after the step of attaching.

13. The method of claim 9, wherein the opening system includes a zone of weakness.

14. The method of claim 9, wherein the opening system includes a tear strip.

15. The method of claim 14, wherein the tear strip consists of an adhesive portion for adhering to said film and a non-adhesive portion to be pulled to release the vegetable from the film.

16. The method of claim 9, wherein the opening system consists of a strip or fiber attached to or beneath the film, wherein an end of the strip or fiber is pulled to release the vegetable from the film.

17. The method of claim 9, wherein the step of shrinking includes heating the film.

18. A method of packaging a vegetable for microwave cooking where the package protects the vegetable and serves as a cooking container comprising the steps of:

selecting a vegetable from a group of different types of vegetables;

providing shrinkable plastic film;

modifying gas permeability of the film according to the selected vegetable to be packaged, wherein the step of modifying includes making a plurality of about 0.02 inch diameter holes throughout the surface area of said film;

attaching an opening system to said film;

sealing the modified film around the selected vegetable; and heat shrinking the film to tightly envelop the selected vegetable.

19. The method of claim 18, wherein the selected vegetable is selected from the group consisting of potatoes, onions, corn, artichokes, brussel sprouts, asparagus and squash.

20. The method of claim 18, further comprising a step of adding at least one of salt, flavors, seasonings, herbs and oils.

21. The method of claim 18, wherein the step of modifying comes after the step of attaching.

22. The method of claim 18, wherein the opening system includes a zone of weakness.

23. The method of claim 18, wherein the opening system includes a tear strip.

24. The method of claim 23, wherein the tear strip consists of an adhesive portion for adhering to said film and a non-adhesive portion to be pulled to release the vegetable from the film.

25. The method of claim 18, wherein the opening system consists of a strip or fiber attached to or beneath the film, wherein an end of the strip or fiber is pulled to release the vegetable from the film.

26. The method of claim 1, wherein the modifying step includes the step of effecting local moisture levels over the surface of the vegetable within the entire package.

27. The method of claim 1, wherein the modifying step includes providing adequate respiration for the packaged vegetable.

28. The method of claim 1, wherein the making a plurality of about 0.02 inch diameter holes step includes the step of allocating a certain number of the holes per square foot of packaging to accommodate the selected vegetable.

29. The method of claim 4, including the step of applying force to the zone of weakness to open the package.

30. The method of claim 6, wherein the adhesive portion remains adhered to the film during the cooking step.

31. The method of claim 9, wherein the modifying step includes the step of effecting local moisture levels over the surface of the vegetable within the entire package.

32. The method of claim 9, wherein the modifying step includes providing adequate respiration for the packaged vegetable.

33. The method of claim 9, wherein the making a plurality of about 0.02 inch diameter holes step includes the step of allocating a certain number of the holes per square foot of packaging to accommodate the selected vegetable.

34. The method of claim 13, including the step of applying force to the zone of weakness to open the package.

35. The method of claim 15, wherein the adhesive portion remains adhered to the film during the cooking step.

36. The method of claim 18, wherein the modifying step includes the step of effecting local moisture levels over the surface of the vegetable within the entire package.

37. The method of claim 18, wherein the modifying step includes providing adequate respiration for the packaged vegetable.

38. The method of claim 18, wherein the making a plurality of about 0.02 inch diameter holes step includes the step of allocating a certain number of the holes per square foot of packaging to accommodate the selected vegetable.

39. The method of claim 22, including the step of applying force to the zone of weakness to open the package.

40. The method of claim 24, wherein the adhesive portion remains adhered to the film during cooking of the selected vegetable.

41. A method of packaging and cooking a vegetable where the package protects the vegetable and serves as a cooking container comprising the steps of:

selecting a vegetable consisting of corn;

preparing the selected vegetable;

providing shrinkable plastic film;

modifying gas permeability of said film to accommodate respiration needs of the selected vegetable to be packaged; wherein the step of modifying includes making a plurality of holes in said film throughout the surface area of the film;

attaching an opening system to the film;

sealing the modified film around the selected vegetable;

shrinking the film to tightly envelop the selected vegetable;

cooking the enveloped vegetable in a microwave oven; and operating the opening system to release the vegetable from the film.

42. The method of claim 41, wherein the modifying step includes the step of effecting local moisture levels over the surface of the vegetable within the entire package.

43. The method of claim 41, wherein the modifying step includes the step of providing adequate respiration for the packaged vegetable.

44. The method of claim 41, wherein the making a plurality of holes step includes the step of allocating a certain number of the holes per square foot of packaging to accommodate the selected vegetable.

45. The method of claim 41, wherein the preparing step further comprises a step of adding at least one of salt, flavors, seasonings, herbs and oils.

46. The method of claim 41, wherein the opening system includes a zone of weakness.

47. The method of claim 46, further comprising applying force to the zone of weakness to open the package.

48. The method of claim 41, wherein the opening system includes a tear strip.

49. The method of claim 48, wherein the tear strip consists of an adhesive portion for adhering to said film and a non-adhesive portion to be pulled to release the vegetable from the film.

50. The method of claim 49, wherein the adhesive portion remains adhered to the film during the cooking step.

51. The method of claim 41, wherein the opening system consists of a strip or fiber attached to, embedded in or in contact with an inner surface of the film, wherein an end of the strip or fiber is pulled to release the vegetable from the film.

52. The method of claim 41, wherein the step of shrinking includes the step of heating the film.

53. The method of claim 41, further comprising marketing the enveloped vegetable.

* * * * *